US007515127B2

(12) United States Patent
Burns et al.

(10) Patent No.: US 7,515,127 B2
(45) Date of Patent: Apr. 7, 2009

(54) PIXEL CIRCUIT AND OPERATING METHOD

(75) Inventors: Dwayne Burns, West Linton (GB); Ian Underwood, Edinburgh (GB)

(73) Assignee: Microemissive Displays Limited, Edinburgh (GB)

( * ) Notice: Subject to any disclaimer, the term of this patent is extended or adjusted under 35 U.S.C. 154(b) by 543 days.

(21) Appl. No.: 10/474,837

(22) PCT Filed: May 1, 2002

(86) PCT No.: PCT/GB02/01999

§ 371 (c)(1),
(2), (4) Date: Oct. 15, 2003

(87) PCT Pub. No.: WO02/089534

PCT Pub. Date: Nov. 7, 2002

(65) Prior Publication Data

US 2004/0113159 A1 Jun. 17, 2004

(30) Foreign Application Priority Data

May 2, 2001 (GB) ..... 0110802.6

(51) Int. Cl.
*G09G 3/32* (2006.01)

(52) U.S. Cl. ..... 345/82; 345/76; 315/169.1

(58) Field of Classification Search ..... 345/76–83; 315/169.1–169.4
See application file for complete search history.

(56) References Cited

U.S. PATENT DOCUMENTS 3,576,394 A * 4/1971 Lee ..... 348/740
4,982,182 A 1/1991 Flinois ..... 340/762
6,229,506 B1 * 5/2001 Dawson et al. ..... 345/82
6,246,386 B1 6/2001 Perner ..... 345/90
6,339,417 B1 1/2002 Quanrud ..... 345/98
6,392,485 B1 * 5/2002 Doi et al. ..... 330/253
6,593,919 B1 * 7/2003 Kishita et al. ..... 345/204
6,646,654 B2 * 11/2003 Takagi ..... 345/690
6,738,031 B2 * 5/2004 Young et al. ..... 345/55
6,801,180 B2 * 10/2004 Matsueda ..... 345/92
6,806,659 B1 * 10/2004 Mueller et al. ..... 315/295
6,806,857 B2 * 10/2004 Sempel et al. ..... 345/92
2001/0043173 A1 11/2001 Troutman ..... 345/82
2002/0186188 A1 * 12/2002 Cok ..... 345/82

FOREIGN PATENT DOCUMENTS

EP 0965976 A1 12/1999
WO WO 99/60557 11/1999

* cited by examiner

*Primary Examiner*—Richard Hjerpe
*Assistant Examiner*—Kimnhung Nguyen
(74) *Attorney, Agent, or Firm*—Howson & Howson LLP

(57) ABSTRACT

A method and circuit for controlling a light emitting element such as a light emitting diode. A pulse coded modulated signal of a set duration is supplied to the element (LED) so as to cause the element to emit light for a period of time depending on the duration of the signal, the apparent brightness of the element depending on said period of time. The signal can be applied by sequentially activating each of a plurality of bit lines (B0, B1, B2), each comprising a storage node (S0, S1, S2), for a binary weighted period of time.

8 Claims, 2 Drawing Sheets

PIXEL CIRCUIT AND OPERATING METHOD

BACKGROUND TO THE INVENTION

The present invention relates to a method and apparatus for controlling a light emitting element. The invention can be used in light emitting diode (LED) arrays and liquid crystal over silicon pixel arrays.

Conventionally, LEDs have been driven using analog drive apparatus. Such apparatus suffers from a number of disadvantages. Distribution of analog current or voltage to a plurality of pixels is prone to noise induced by any digital switching of nearby control signals. Multiple analogue distribution circuits can be used to reduce bandwidth requirements, but these have inherent mismatching due to the variability in transistor characteristics on standard semiconductor manufacturing processes. When an analogue value is stored at a pixel, no more than a few percent of the original value should be lost in a typical (60 Hz) frame refresh time of 16.666 ms. This is difficult to achieve because of inherent temperature and light-induced charge leakage of capacitive storage nodes. The transfer of analogue voltage or current to an LED may be affected by threshold voltage variability across a plurality of pixels. Finally, LED devices do not have linear voltage-to-light or current-to-light transfer characteristics.

SUMMARY OF THE INVENTION

From a first aspect, the present invention provides a method of controlling a light emitting element, comprising supplying a pulse coded modulated signal of a set duration to the element so as to cause the element to emit light for a period of time depending on the duration of the signal, the apparent brightness of the element depending on said period of time. When a plurality of elements, each comprised in a pixel of an array, is driven in this manner, a high quality grayscale reproduction of an image can be achieved. Pulse coded modulation does not require the light emitting element to have linear voltage-to-light or current-to-light transfer characteristics, because linearity is provided in the time domain.

Preferably, the pulse code modulated signal is provided by storing data at none, one, some or all of a plurality of bit lines connected, at least indirectly, to the element in parallel, and activating all of said bit lines so as to form the signal from a combination of the data. The bit lines are preferably activated sequentially, and for example they can be activated for binary weighted periods.

The method may comprise a step of refreshing said data stored at the bit lines array during a periodic refresh cycle.

From a second aspect, the present invention also provides a pixel circuit comprising a light emitting element and means for supplying a pulse coded modulated signal of a set duration to the element so as to cause the element to emit light for a period of time depending on the duration of the signal, the apparent brightness of the element depending on said period of time.

Preferably, the means for supplying the pulse code modulated signal comprises a plurality of storage nodes connected, at least indirectly, to the light emitting element in parallel, each of the storage nodes being capable of storing a data bit. The data bit is preferably stored as an electric charge, and for this purpose each storage node may comprise a capacitance such as the gate of a metal-oxide-semiconductor field effect transistor (MOSFET).

Since only digital values are stored, there is an increased charge leakage margin compared to storing analog values.

Preferably, the circuit comprises means for refreshing the data stored at the storage nodes to nullify the effects of temperature- and light-induced charge leakage.

The light emitting element may comprise a light emitting diode (LED). If so, a complementary metal-oxide-semiconductor (CMOS) inverter may be provided at the anode of the LED. Such an inverter provides excellent rail-to-rail voltage levels.

Other drive schemes rely on complicated threshold voltage variation cancellation techniques. The only threshold variation not taken into account in the CMOS inverter is the diode threshold voltage variation which is typically less than 1%.

In an alternative embodiment, the light emitting element comprises a liquid crystal display element, the pixel circuit including an XOR gate for charge balancing.

From a third aspect, the invention provides an optoelectronic device comprising an array of pixel circuits as defined above. Each pixel circuit stores a representation, for example a binary representation, of a grayscale value. There is therefore no need for an intermediate frame store as required in temporally multiplexed grayscale LCOS systems.

The array preferably comprises a plurality of bit lines, one bit line for addressing each of the storage nodes in all of the pixel circuits in a line in the array. Such bit lines are preferably operable to distribute data bits to the storage nodes. Subsequently, the bit-select lines are preferably operable to select the storage nodes and apply their stored data so as to generate the pulse code modulated signal.

Preferably, the storage nodes in each pixel circuit are accessed simultaneously via the bit lines in each of three modes, (write mode, refresh mode and display mode), but the storage nodes could be accessed simultaneously (that is, in parallel), serially (that is, individually), or in groups.

The array may comprise a refresh mechanism for simultaneously refreshing the data stored at the storage nodes in all of the pixel circuits in the array during a periodic refresh cycle. The refresh mechanism can apply a refreshing voltage via the bit lines.

BRIEF DESCRIPTION OF THE DRAWING

The present invention will now be described in more detail, by way of example only, with reference to the accompanying drawings, in which.

DETAILED DESCRIPTION OF THE PREFERRED EMBODIMENTS

Figure 1:
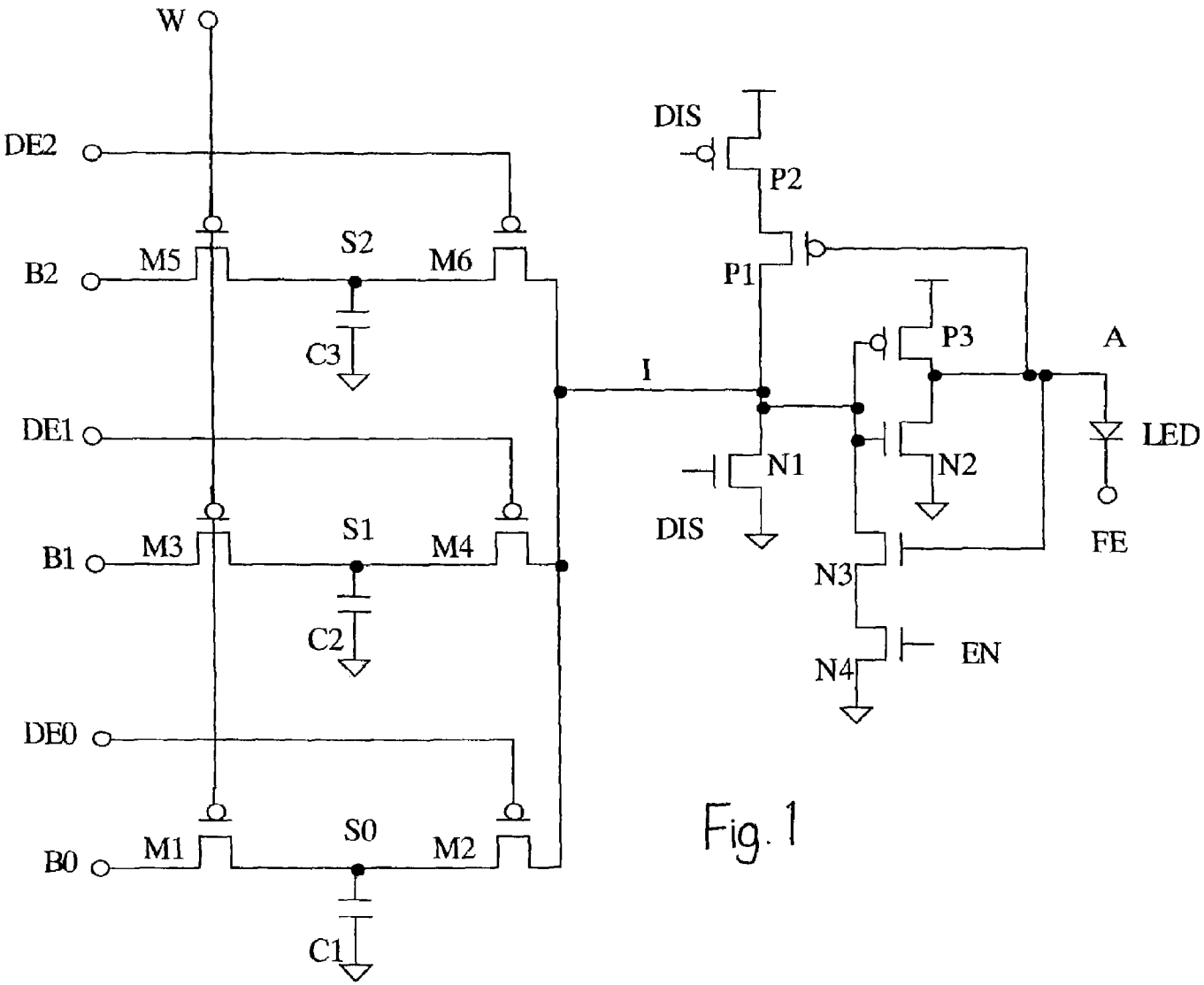
FIG. 1 is a circuit diagram of a pixel circuit according to an embodiment of the invention.

FIG. 1 shows a pixel circuit consisting of a plurality (three in this example) of dynamic storage nodes S0, S1, S2, multiplexed together at a node I which is connected to a level-restoring circuit, and thence to an LED.

The number of storage nodes depends on how many gray levels are required. Each storage node stores one bit of a data value. If the bits represent binary weighted values, n storage bits can represent $2^n$ grayscale values. In the example shown, n=3 and the circuit is capable of generating eight discrete gray levels. However, the invention is not restricted to binary weighted storage. In an alternative embodiment, each bit could have equal weight, giving a circuit in which n storage bits represent n+1 grayscale values.

Write Mode

A bit line bus comprising bit lines B0, B1, B2 is common to a line (where line can refer to a row or column) of pixels. Voltage values are sampled from the bus onto the storage nodes S0, S1, S2 by asserting a word line W (common to a line of pixels which is typically orthogonal to the bit line bus). A display-enable-bus signal DE0, DE1, DE2 is de-asserted while W is asserted to ensure storage nodes are not shorted together (for example, via transistors M1, M2, M4 and M3, if B0, B1, and DE0 and DE1 are asserted).

In the example shown, the storage nodes S0, S1, S2 are implemented using capacitors. This is not a requirement, as any method for storing charge, for example the gate of a transistor, is within the scope of the present invention. Once a plurality of bits has been presented to the plurality of storage nodes, W can be de-asserted.

Display Mode

The voltage on node I controls the voltage applied to the anode of the LED. The display mode is controlled by the appropriate sequence of assertions of the DE-bus, DIS and EN signals (W is de-asserted). The DIS signal is asserted, and the EN signal de-asserted, to set node I to a voltage that will ensure that feedback transistor P1 is in its off state.

Once DIS has been de-asserted, the DE bus can be used to select which one of the storage nodes S0, S1 or S2 is connected to node I. This selection apparatus is commonly referred to as a multiplexer. In the preferred embodiment, only one of the multiplexer lines DE0, DE1 and DE2 is asserted simultaneously. If more than one of these lines is asserted simultaneously, the corresponding storage nodes would be shorted together and the stored values could become corrupted.

The voltage on node I controls the voltage applied to the anode A of the LED. The FE signal is common to the cathodes of the LEDs in all of the pixel circuits of the array.

If each one of the storage nodes S0, S1, S2 is connected to node I by asserting each of the multiplexer lines DE0, DE1 and DE2 respectively in turn for a binary weighted period, the LED will receive a train of digital pulses corresponding to the binary weighted value stored on the storage nodes. This pulse train is commonly referred to as pulse coded modulation.

Refresh Mode

The transistors P3 and N2, comprising an inverter, and the transistor P1, are used to restore the voltage on node I to a full logic level. This ensures that there is no short-circuit current flowing through P3 and N2 under quiescent conditions. This configuration also has the added benefit of restoring the voltage on whichever storage node is currently being read, thus nullifying the effects of any temperature- and/or light-induced charge leakage.

Each of the storage nodes S0, S1, S2 is automatically refreshed every time it is connected, using the DE-bus signals, to node I when the pixel is in display mode. However, the time interval between storage node accesses may be too large if each storage node is only accessed once every frame (16.666 ms for a 60 Hz frame rate), so that charge leakage corrupts the stored values. This can be avoided by incorporating a refresh sequence, in which each storage node is connected to node I for just enough time to offset the effects of charge leakage. This can be performed on a global basis to all pixel circuits simultaneously, and can be completed in a time that is insignificant with respect to the display frame rate.

The multiplexer with the P1 restoring transistor is known per se, but as far as we are aware, such a transistor has not hitherto also been used to provide intra-pixel refresh circuitry by appropriate sequencing of bus lines.

Figure 2:
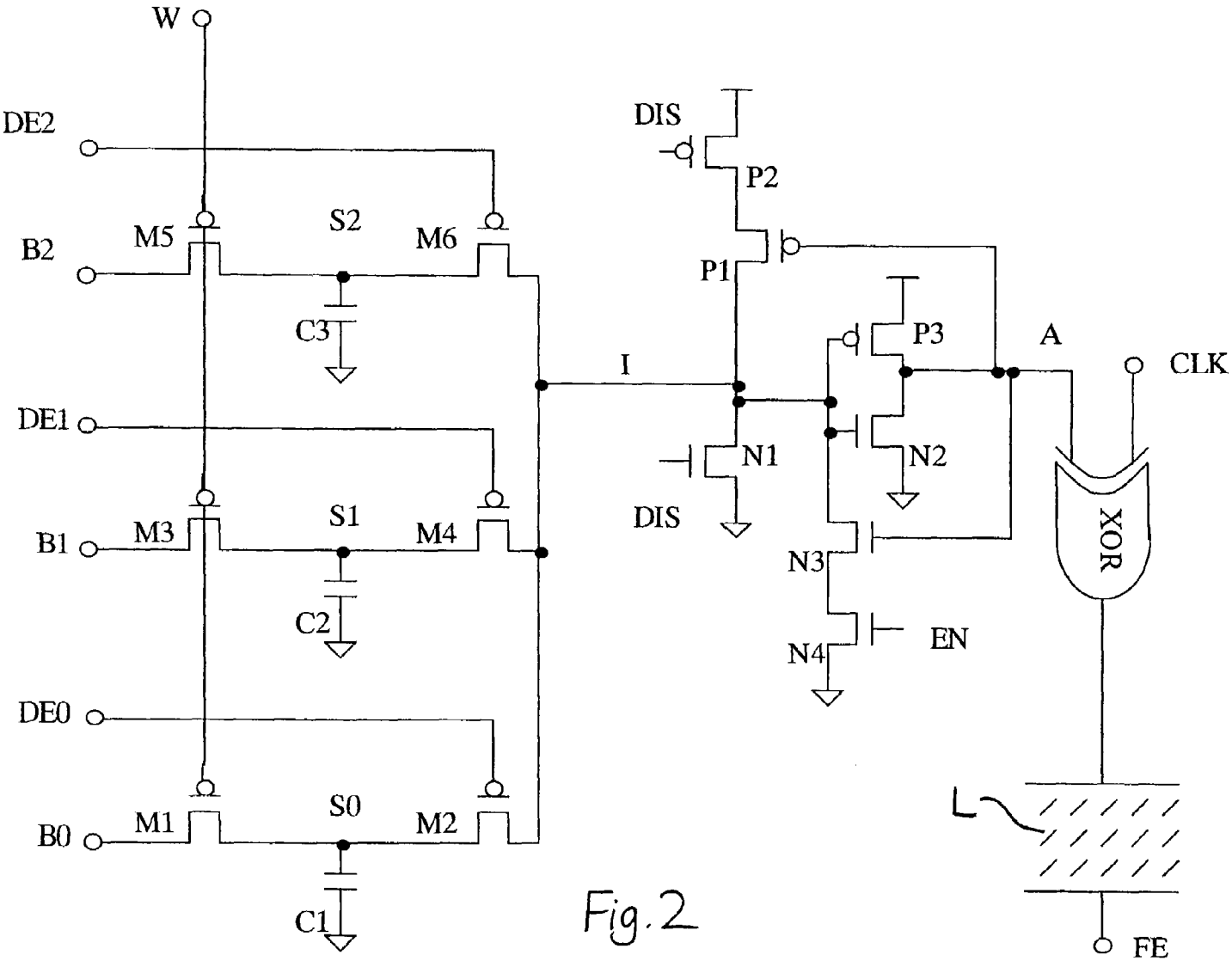
FIG. 2 is a circuit diagram of a pixel circuit according to an alternative embodiment.

FIG. 2 shows an alternative embodiment in which the light emitting element comprises a liquid crystal display element L. The charge balancing required by this element is carried out efficiently by providing a clock signal CLK, with a 50% duty cycle, to an XOR gate whose output is connected to the element L.

Whilst particular embodiments of the invention have been described above with reference to the drawings, modifications may be made without departing from the scope of the appended claims. For example, the PMOS transistors M1 to M6 could be replaced by NMOS transistors.

All forms of the verb "to comprise" in this specification have the meaning "to consist of or include".

The invention claimed is:

1. A pixel circuit comprising:

a light emitting element comprising a light emitting diode (LED) with a complementary metal-oxide-semiconductor (CMOS) inverter being provided at the anode of the LED;

means for supplying a pulse coded modulated signal of a set duration to the element so as to cause the element to emit light for a period of time depending on the duration of the signal, the apparent brightness of the element depending on said period of time, said means for supplying the pulse code modulated signal comprising a plurality of storage nodes connected, at least indirectly, to the light emitting element in parallel, each of the storage nodes being capable of storing a data bit; and means for refreshing the data stored at the storage nodes.

2. A pixel circuit according to claim 1, wherein the data bit is stored as an electric charge.

3. A pixel circuit according to claim 2, wherein each storage node comprises a capacitance.

4. An optoelectronic device comprising an array of pixel circuits, each of said pixel circuits having a light emitting element and means for supplying a pulse coded modulated signal of a set duration to the element so as to cause the element to emit light for a period of time depending on the duration of the signal, the apparent brightness of the element depending on said period of time, said array comprising a plurality of bit lines, one bit line for addressing each of a plurality of storage nodes in all of the pixel circuits in a line in the array, wherein corresponding storage nodes in each pixel circuit are accessed simultaneously via the bit lines in each of three modes: write mode, refresh mode and display mode, and wherein the array comprises a refresh mechanism for simultaneously refreshing data stored at the storage nodes in all of the pixel circuits in the array during a periodic refresh cycle.

5. A device according to claim 4, wherein the bit lines are operable to distribute data bits to the storage nodes.

6. A device according to claim 5, wherein subsequent to the distribution of data bits, bit-select lines are operable to select the storage nodes and apply their stored data so as to generate the pulse code modulated signal.

7. A device according to claim 4, wherein the refresh mechanism is operable to apply a refreshing voltage via the bit lines.

8. A pixel circuit comprising:

a light emitting element;

means for supplying a pulse coded modulated signal of a set duration to the element so as to cause the element to emit light for a period of time depending on the duration of the signal, the apparent brightness of the element depending on said period of time, said means for supplying the pulse code modulated signal comprising a plurality of storage nodes connected, at least indirectly, to the light emitting element in parallel, each of the storage nodes being capable of storing a data bit; and means for refreshing the data stored at the storage nodes;

the light emitting element comprising a liquid crystal display element, the pixel circuit including an XOR gate for charge balancing.

* * * * *